US005892444A

United States Patent [19]

Wittmer et al.

[11] Patent Number: 5,892,444

[45] Date of Patent: Apr. 6, 1999

[54] ALARM SYSTEM FOR A CARD HOLDER

[75] Inventors: Kenneth E. Wittmer; Cliff Evans, both of Newtown, Conn.

[73] Assignee: Guardian Product Development, Inc., Danbury, Conn.

[21] Appl. No.: 5,438

[22] Filed: Jan. 10, 1998

[51] Int. Cl.[6] ..... G08B 13/14

[52] U.S. Cl. ..... 340/571; 340/568.1; 340/568.7

[58] Field of Search ..... 340/568, 571, 340/522, 568.1, 568.7

[56] References Cited

U.S. PATENT DOCUMENTS

| | | | |
|---|---|---|---|
| 3,959,789 | 5/1976 | McGahee | 340/568 |
| 4,721,948 | 1/1988 | Lin | 340/568 |
| 4,890,094 | 12/1989 | Kopel | 340/571 |
| 5,034,724 | 7/1991 | Tone | 340/571 |
| 5,373,283 | 12/1994 | Maharshak | 340/568 |
| 5,739,744 | 4/1998 | Roca et al. | 341/20 |

*Primary Examiner*—Jeffrey A. Hofsass
*Assistant Examiner*—Van T. Trieu
*Attorney, Agent, or Firm*—Robert A. Seemann

[57] ABSTRACT

A flexible resilient ribbon having first and second conductive surfaces is wrapped over the top edge of a pocket wall forming a bowed-out first conductive surface adjacent to the top edge of the wall which biases the first conductive surface into contact with the second conductive surface when a card is absent from the pocket, an alarm circuit IC terminal is connected by a network which includes a fixed resistor to power supply negative and the first and second conductive surfaces each of carbon, in series removable contact, connected to power supply positive.

14 Claims, 5 Drawing Sheets

ALARM SYSTEM FOR A CARD HOLDER

BACKGROUND OF THE INVENTION

1. Field of the Invention

The invention pertains to an alarm system for a card or document holder pocket, more specifically to a self-contained portable alarm system having a unitary ribbon which is folded over the edge of a pocket opening and folded within the pocket and which gives alarm when the card or document is removed.

2. Description of the Prior Art

The prior art is replete with patented designs for card holder alarm systems that signal a warning when a card such as a credit card is removed from a wallet pocket.

U.S. Pat. No. 3,959,789 patented by F. M. McGahee on May 25, 1976 describes a check or credit card monitor consisting of a case having an alarm circuit, time delay circuit, power supply, and a cover having a plurality of separators adapted to hold documents between them. Each separator has an electrical contact. The separators are biased together by a spring clip so that the electrical contacts touch one another when the card is removed from between the electrical contacts.

U.S. Pat. No. 4,480,250 patented by C. D. McNeely Oct. 30, 1984 describes a wallet having an alarm circuit connected to a plurality of electrically and mechanically parallel metal clips and a printed circuit conductor line. Each clip independently closes mechanically and electrically on a printed circuit conductor line unless the closing is prevented by an intervening credit card in the clip. A single closing of the parallel circuits is sufficient to activate the alarm circuit.

U.S. Pat. No. 4,652,865 patented by A. Maharshak on Mar. 24, 1987 describes a plurality of pockets in which each pocket has conductive disks on the pocket walls at the center of each inner side of the pocket so that they contact when the card is removed from the pocket. One of the disks is magnetic so that the disks are drawn together.

In another embodiment electrical conductive areas on the pocket walls on the opposite inside surfaces of the pockets are biased toward one another by leaf springs inserted into the spaces between outer and inner layers of the walls of the pockets.

In another embodiment a pair of parallel conductive strips spaced from one another and parallel to the edge of the pocket opening traverse one inner face of the pocket. A longitudinal plate is positioned on the opposite inner face of the pocket so that it crosses both strips.

In another embodiment a single conductive strip extends approximately corner to corner of one inner face of the pocket the ends being spaced from the top and bottom of the pocket, and a single conductor strip extends approximately corner to corner of the opposite inner face of the pocket the ends being spaced from the top and bottom of the pocket, so that the conductors intersect at about the center of the pocket. The conductors pass through the seams of adjacent pockets so that the contact arrangement at the center of the pocket is in each pocket.

U.S. Pat. No. 4,890,094 patented Dec. 26, 1989 by D. Kopel describes a wallet structure in which the pockets are made from a long flexible dielectric sheet that is folded normal to the length of the sheet in a fan fold to form card accommodating compartments by various means including adhesive and/or stitching Preferably a decorative material such as leather is secured around the dielectric sheet and over its exposed edges.

A first conductive bus extends the length of a front surface of the sheet adjacent to one edge of the sheet. A second conductive bus extends the length of the front surface of the sheet adjacent to the other edge of the sheet, parallel to the first conductive bus. Each of the first and second busses continues over each fold normal to the fold and coincides with itself in each pocket formed by the folds.

Alternating conductive strips on the front surface extend from each conductive strip normal to the strip, separated by and spaced from fold lines of the accordion fold so that in each pocket a strip from the first conductive bus on one inner wall of a pocket contacts a strip from the second conductive bus on the opposite inner wall of the pocket at the center of the pocket. The contact activates an alarm. Contact is prevented by an intervening credit card in the pocket.

In order to assure contact between the strips in each pocket in the absence of a credit card between them, a plurality of resilient cushioning pads are secured to the rear surface of the dielectric sheet, one pad of the plurality of pads behind one of the conductive strips in each pocket.

SUMMARY OF THE INVENTION

It is one object of the invention to provide an alarm system for a credit card pocket in which the card sensor comprises a single flexible ribbon that is folded across the top of and into the pocket.

It is another object of the invention to provide an alarm system for a credit card pocket in which the card sensor comprises a unitary flexible ribbon comprising conductive surfaces of the ribbon for sensing absence of a card, that is folded across the top of and into the pocket.

It is another object of the invention to provide an alarm system for a document holder having a plurality of pockets for holding the documents, in which the alarm system comprises a single unitary flexible ribbon comprising conductive surfaces of the ribbon for sensing absence of a card, that is folded across the top of and into each of the plurality of pockets.

It is another object of the invention to provide an alarm system for a document holder having a plurality of pockets for holding the documents, in which a document presence sensor comprises a single, unitary flexible ribbon having planar surface sensor contacts on the ribbon, that is folded across and into each of the plurality of pockets of any size pocket, or of variable size pockets, wherein in each pocket a card sensor area is automatically adjacent to an edge of the opening of each pocket.

It is another object of the invention to provide an alarm system for a document holder having a plurality of pockets for holding the documents, in which the alarm system document presence sensor comprises a unitary flexible ribbon having planar areas of electrically conductive surfaces of the ribbon, that is folded across and into each of the plurality of pockets of any size pockets, wherein one of the planar areas of electrically conductive surface is continuous above and adjacent to an edge of a pocket on the inside of the pocket.

Other objects and advantages will become apparent to a reader from the ensuing description.

- a flexible resilient ribbon includes a first dielectric side and a second side, a first electrical bus extends along the ribbon lengthwise, a second electrical bus extends along the ribbon lengthwise,
- a first conductive surface on the first dielectric side of the ribbon is connected to the first bus and extends along a lengthwise portion of the first dielectric side of the ribbon, a second conductive surface on the first dielectric side of the ribbon is connected to the second bus and extends along a lengthwise portion of the first dielectric side of the ribbon and is spaced lengthwise from the first conductive surface, an electrical circuit connected to the first bus and to the second bus includes means for emitting an alarm when the first conductive surface electrically contacts the second conductive surface, and an electrical power source adapted to operate the electrical circuit, the flexible resilient ribbon is wrapped over the top edge of the first wall of the pocket and extends into the pocket over the interior face of the first wall, bowed inward away from the first wall's interior face adjacent to the top edge of the first wall, the ribbon is folded near the bottom of the pocket, and the second conductive surface extends over an interior face of a second wall of the pocket, opposite the first conductive surface so that the second conductive surface is in electrical contact with the first conductive surface at the inward bowed location when the pocket is empty.

The electrical circuit includes means for delaying the alarm for a length of time after the contact is made.

In one embodiment the first conductive surface is wrapped over the top edge of the first wall.

Preferably the first conductive surface is substantially carbon.

The electrical circuit comprises an IC terminal connected to the electrical power source by a balance circuit that includes a fixed resistor connected to the electrical power source negative and to the IC terminal, and a pair of carbon conductive surfaces which include the first conductive surface and the second conductive surface in series removable contact connected to the electrical power source positive and to the IC terminal.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
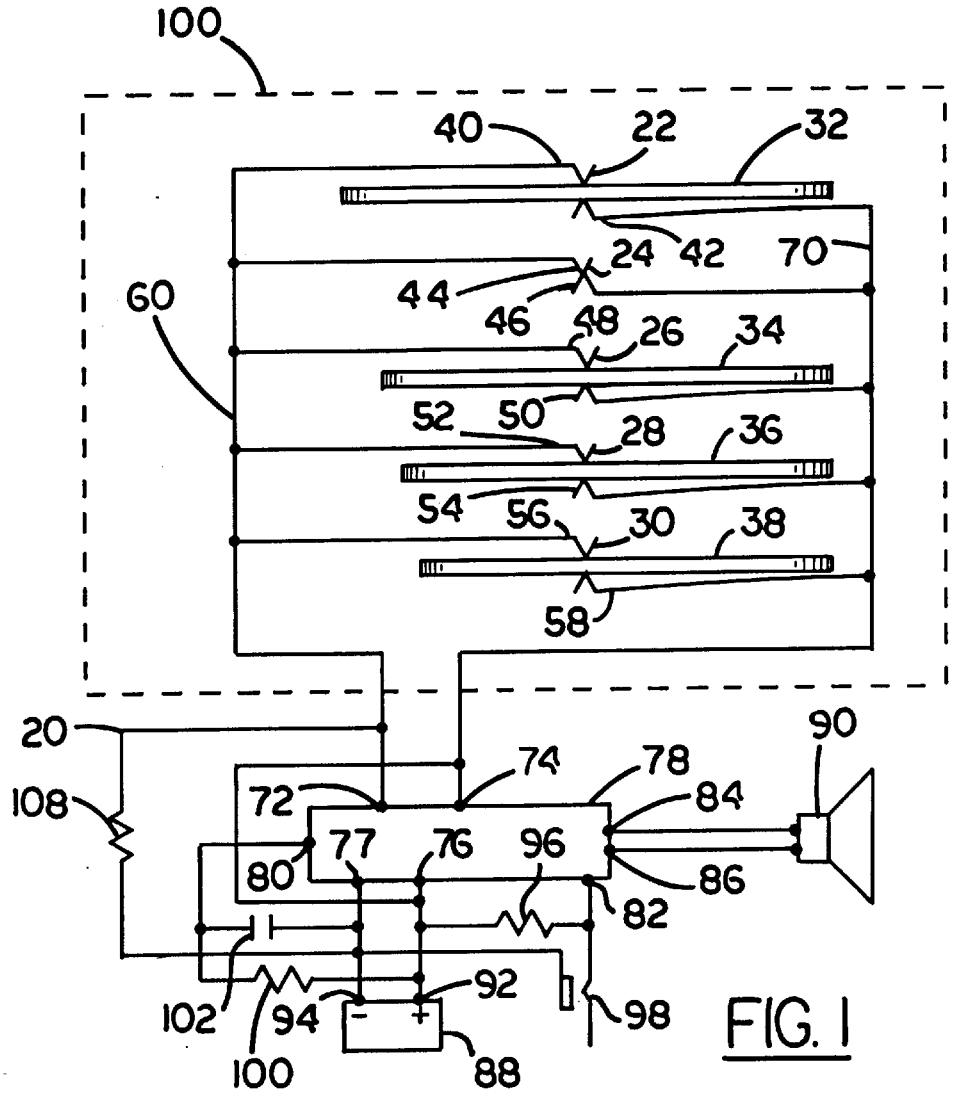
FIG. 1 is a schematic diagram of an electrical circuit of the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1 electrical contact sets 22, 26, 28, and 30 of alarm system 20 are held open by intervening credit cards 32, 34, 36, and 38. Contact set 24 is closed in the absence of a credit card between contacts 44, 46 of the set.

Contacts 40, 44, 48, 52, and 56 are connected in parallel to bus 60. Contacts 42, 46, 50, 54, and 58 are connected in parallel to bus 70.

Bus 60 and bus 70 are connected to integrated circuit or IC 78.

One IC which may be used in the invention is National Semiconductor COP-912 microcontroller of which seven active pins are used, five inputs and two outputs.

The inputs are battery positive 76, battery negative 77, resistance/capacitance oscillator tune 80, reset 82, and awaken circuit pins 72 and 74 which are connected respectively to bus 60 and 70.

The output pins are push-pull audio driver 84, 86, which are connected to speaker 90.

The IC is powered by a 3 volt lithium cell. When all the contact sets are open the IC circuit is in a sleep mode wherein it consumes less than one microampere of current. When an intervening card is removed from one of the contact sets, the IC circuit is triggered by the closed circuit received at pins 72/74 into an awake mode wherein the average current draw is less than one milliampere, excluding the momentary beep audio drive to the speaker.

The battery is connected directly to pins 77 and 76 so that the IC is on power for the operational life of the battery. There is no need for an on/off switch in the battery line.

Reset 82 is pulled high by external resistor 96 connected to battery positive 92. When power is first applied to the IC it must be reset in order to begin operation in the sleep mode.

This is done by pulsing reset pin 82 low for a minimum of 10 clock periods, each clock period being preferably about 10 microseconds. Reset is accomplished by momentarily connecting the reset pin to battery negative 94 by closing switch 98. A reset button may be made from a yieldable portion of a plastic case for the IC and battery.

Circuit timing is derived from a 1 megahertz R/C oscillator internal to the IC. The frequency of oscillation is determined by external resistor 100 and capacitor 102 having one of their ends connected to pin 80. The other end of resistor 100 is connected to battery positive. The other end of capacitor 102 is connected to battery negative. The internal oscillator stops when the IC circuit is asleep.

The IC circuit enters and exits the sleep mode based on the condition of wake-up pin 72 which is connected to battery 88 negative through external resistor 108. Pin 74 is connected to battery positive. An open circuit between pins 72 and 74 such as when all contact sets 22, 24, 26, 28, and 30 are open by intervening credit cards, causes the IC circuit to enter and remain in the sleep mode. A short-circuit between pins 72 and 74 such as when one of the contact sets closes when a card is removed from the set will automatically cause the IC circuit to wake up and proceed with operational steps.

Section 100 of system 20 is formed from a flexible ribbon of the invention.

Speaker 90 is preferably of the miniature piezoelectric type. The output drive to the speaker is square wave which is rich in harmonic tones. Output pins 84,86 are set low when not generating a tone so as not to produce a permanent set in the piezo element of the speaker.

Preferably the cavity for holding the edges of the piezo element is designed to resonate at the audio output frequency. A frequency of about 2,500 hertz is preferred because of its pleasant sounding quality and because most hearing loss occurs at higher frequencies. Tone bursts are short and dual, to produce a noticeable but not objectionable alert.

Trigger sensitivity level for an open or connected condition between the terminal pads is determined by pull-down resistor 108 and the wake-up voltage threshold level for the IC which is a high impedance sensor input network at pins 72, 74.

The card detector tape is connected to battery positive and a high impedance sensor input on the circuit. When all card positions are occupied, the detector tape is essentially open circuit and therefore no voltage appears on the sense pin. A resistor is connected from the sense resistor to ground to shunt any leakage current. The resistor also sets the triggering level for the detector tape.

When a card is removed, the folded tape touches creating a resistive short. The resistive value is a function of the touch pressure. Even with a light touch, a noticeable decrease in resistive value occurs. The voltage that appears on the sense pin is determined by the ratio of the sense resistor and the detector tape resistance. The voltage must rise 70% of the battery voltage to be detected by the circuit. Lowering the sense resistor decreases the sensitivity of the card detection. A high value sense resistor increases the card detection sensitivity.

When the circuit is running, it continuously checks the card detector input. If the input is high, a card is missing and the circuit will output periodic double beeps. When the input drops low, all cards are present, and the circuit will output a single beep and halt operation. In the halt state the circuit draws no current, thereby preserving battery life.

Two methods are available to activate the circuit and switch it to its running move. One method is to drive the circuit reset input low, by pressing the reset button. The second method is to raise the voltage on the sense input above its threshold value, which occurs when a card is removed.

The advantages of using the detector tape as a sensor rather than as a power switch include:

Highly conductive traces for the conductive surfaces on the detector tape are not required. Low resistance tracks are normally etched from metal or printed using silver based ink, which is expensive and tarnishes. Carbon based ink, although moderately conductive is inexpensive and produces conductive surfaces which are stable and self-healing.

Touch resistance is a function of pressure. To use the tape as a power switch, the touch electrical resistance must be low, thereby requiring high pressure. High touch pressure is normally achieved by placing spring clips or foam on the card pockets. This increases wallet thickness, adds cost, complicates installation, and is not suitable for removable installation of the present invention.

The present invention works with carbon based conductive surfaces on the unitary tape without the use of additional clips, springs, pressure pads.

Figure 2:
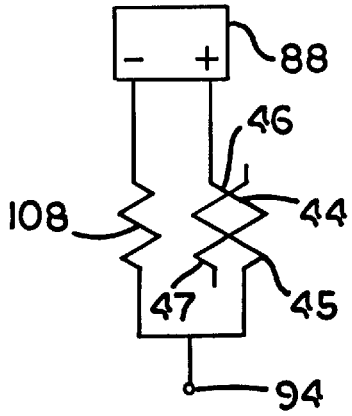
FIG. 2 is a schematic diagram of a portion of the electrical circuit of FIG. 1.

FIG. 2 shows the electrical circuit of a pair of contacts with the card removed, to IC 78 and the battery. Pin 94 is connected to the battery by the balance circuit of fixed resistor 108 connected to battery negative, and a pair of carbon conductive surfaces 45, 47 in series removable contact connected to battery positive.

Figure 3:
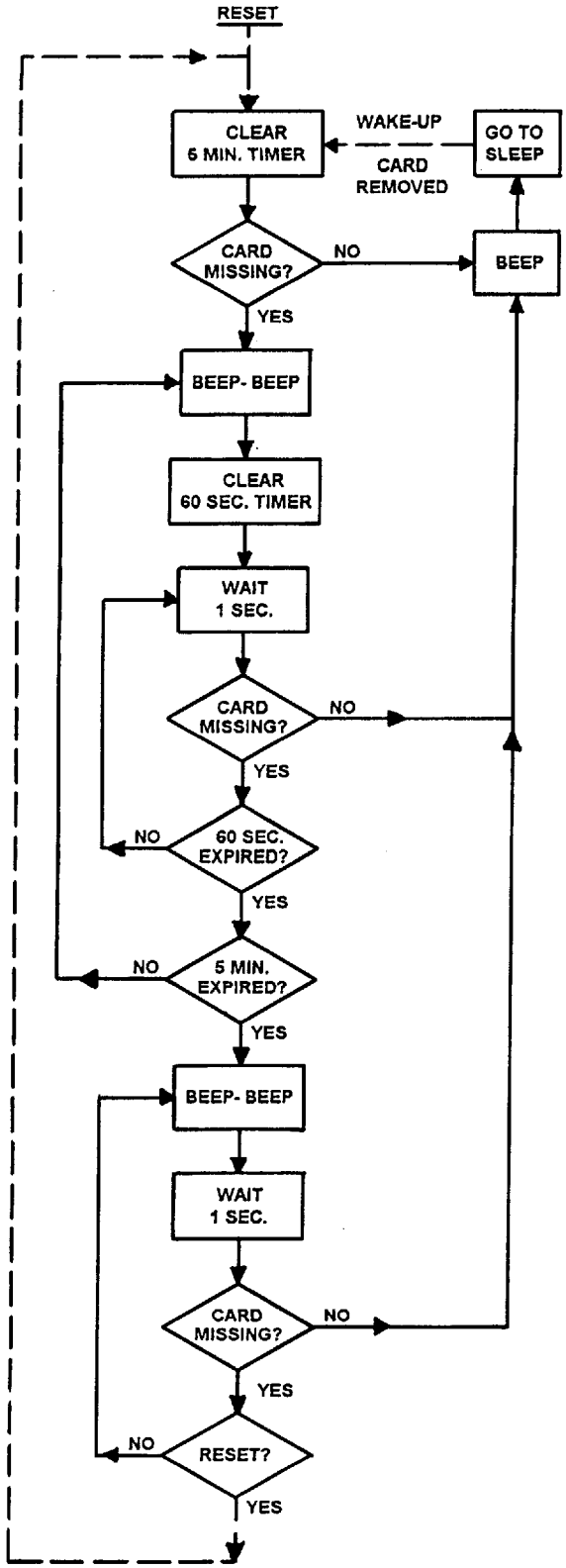
FIG. 3 is a block diagram of operating steps of a circuit of the invention.

Referring to FIG. 3, when reset or awakened, the IC circuit will immediately output a short double beep to indicate that it is processing. It then checks the status of wake-up pin 72. If the pin is high indicating a missing card, the circuit will produce a beep-beep reminder every 60 seconds. If the missing card condition exceeds five minutes, the IC will generate a continuous beeping alarm incorporating the one second wait. The alarm can be cleared by pressing the reset switch 98 which restarts the timing process.

When reset, the IC circuit will return to its 60 second reminder beeps and will again go into alarm when another five minute period passes.

The only way to silence the reminder beeps and subsequent alarm is to replace the missing card. When all card pockets are filled, the IC will sense a low condition on its wake-up pin, produce a single beep and then enter the sleep mode and go silent.

Figure 4:
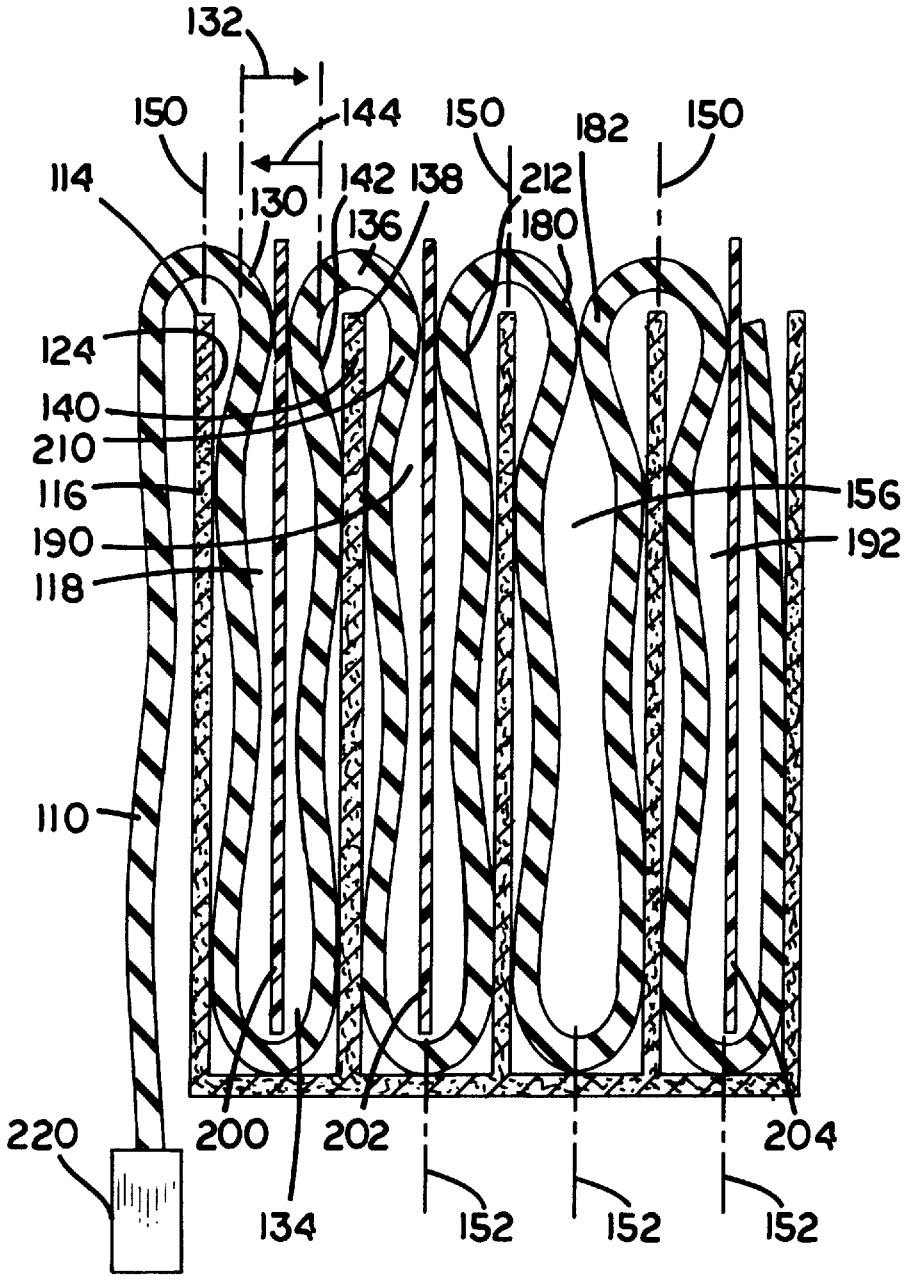
FIG. 4 is a schematic cross section view of a ribbon installed in a pocket.
Figure 5:
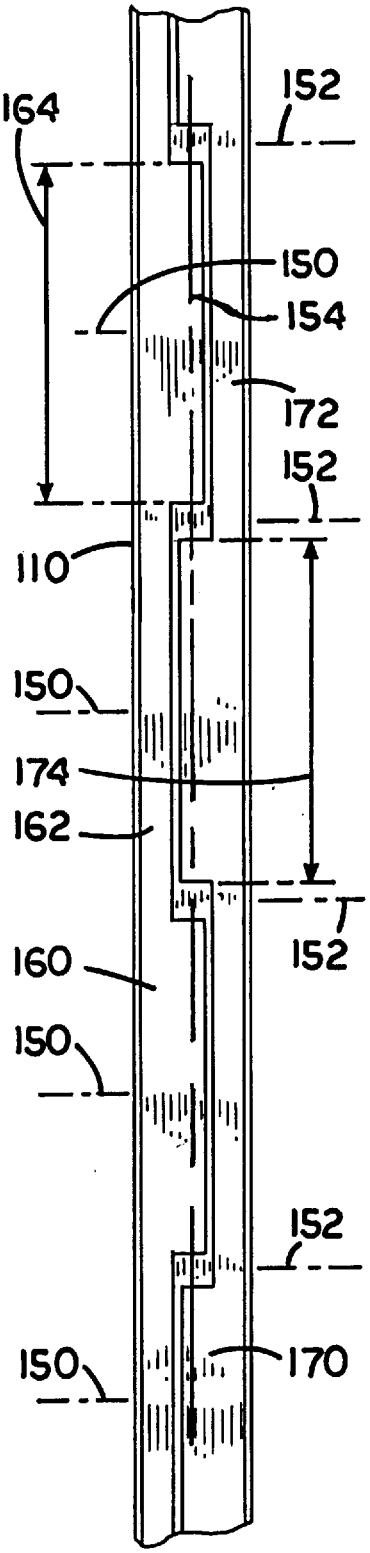
FIG. 5 is a schematic front view of the ribbon of FIG. 4.
Figure 6:
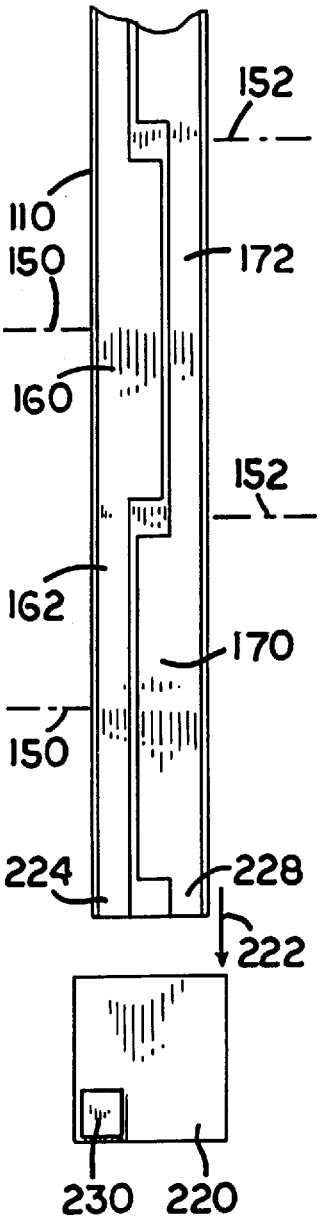
FIG. 6 is a schematic front view of the ribbon of FIG. 4.

Referring to FIGS. 4–6, flexible resilient ribbon 110 is folded over top edge 114 of wall 116 of pocket 118 of credit card wallet 120, and extends into the pocket over interior face 124 of wall 116. Ribbon 110 is designed to have sufficient resiliency to cause it to bow 130 inward 132 under the effect of the ribbon being folded or creased upward over top edge 114.

Ribbon 110 is folded within 134 the pocket and is folded 136 over top edge 138 of wall 140. Ribbon 110 bows 142 inward 144 and 146 from its resilience at fold 136.

Fold line 150 of the ribbon at the top edge of the pocket opening is called the fold-up line. Fold line 152 of the ribbon between the fold-up lines, where the ribbon bottoms out in the pocket is called the fold-down line. Fold lines 150 and 152 are marked by dots on the ribbon to indicate to the user where to make the folds.

In ribbon 110, conductive surfaces 160 on the front of the ribbon each connect to longitudinal bus 162 and extend along a lengthwise portion 164 of the ribbon. Conductive surfaces 170 each connect to longitudinal bus 172 and extend along a lengthwise portion 174 of the ribbon. The back of the ribbon is non-conductive substrate material.

A "conductive surface" of a ribbon of the invention is defined herein as a surface of the ribbon which will pass electrical current to an electrical conductor when the electrical conductor is brought into contact with the conductive surface. A conductive portion of the ribbon which is covered with insulation so that it will not pass electrical current to an electrical conductor upon contact is not a conductive surface.

Conductive surfaces 160 and 170 are planar with the ribbon, being applied by plating, spraying or other means to provide a conductive surface which follows the surface of a ribbon and flexes with the ribbon.

The term "planar" with respect to the conductive surface or a conductive portion of a ribbon of the invention is defined herein as a conductive surface or conductive portion which generally follows the surface of the ribbon and bends with the ribbon surface when the ribbon is bent.

In one embodiment, the ribbon substrate material is 0.005 clear flexible polyester. The bus and conductive surfaces comprise a base of flexible silver ink and are planar. The conductive surfaces are substantially carbon, being coated with conductive carbon ink over the silver ink.

In another embodiment, the bus and conductive surfaces comprise a base of flexible silver ink. The conductive surfaces are substantially carbon, being coated with conductive carbon ink over the silver ink, and the bus is coated with a flexible dielectric (insulation).

Another ribbon substrate may be used. It should be flexible and resilient so that the ribbon bows adjacent to the top of the wall over which it is folded. Other substrates including fiberglass, and stiff plasticized paper can be used.

In pocket 156, conductive surface 160 makes electrical contact with conductive surface 170 at inward bows 180 and 182 of the respective surfaces. Conductive surfaces 160 and 170 are biased against one another into electrical contact by the resiliency or springiness of bows 180 and 182.

In pockets 118, 190 and 192, conductive surface 160 is prevented from making electrical contact with conductive surface 170 by intervening credit cards 200, 202, and 204.

When the bus is coated with a dielectric, the tape cannot be electrically shorted across the buses or across conductive surfaces 160, 170 by conductive ink designs on a face of a card.

The distance of the ribbon between the fold-down and fold-up lines is predetermined to fit a card or document so that the card or document when resting in the pocket extends between inward bows 180 and 182, 130 and 132, and 210 and 212.

In one embodiment, a tape designed for vertically pocketed wallet-size credit cards has distances between fold-up and fold-down being about 3 inches.

In another embodiment, a tape designed for horizontally pocketed wallet-size credit cards has distances between fold-up and fold-down being about 2 inches.

In another embodiment a tape designed for horizontally pocketed 8.5 inches by 11 inch paper has distances between fold-up and fold-down being about 7.5 inches. Referring to FIG. 5, from fold lines 150 being through conductive surfaces 160 and 170 it is seen that when ribbon 110 is wrapped over the top edge of a first wall of a pocket and is adjacent to the top edge of the opposite second wall of the pocket, conductive surface 160 is wrapped over the top edge of the first wall, conductive surface 170 is adjacent to the top edge of the opposite wall of the pocket, and conductive surface 160 is wrapped over the top edge of the first wall on a line 154 longitudinal with the ribbon through conductive surface 170.

Tape 110 is 0.5 inches wide. It is removably connected to electronics case 220 by inserting 222 ends 224 and 228 into the case. The tape is removably inserted in the pockets. The case is approximately 2.25 inches long by 1 inch wide by 0.125 inches thick and includes the battery. Flap 230 can be pressed to close the reset switch of the circuit contained therein. In most wallets, the addition of the case and tape will hardly increase the thickness of the wallet.

Figure 7:
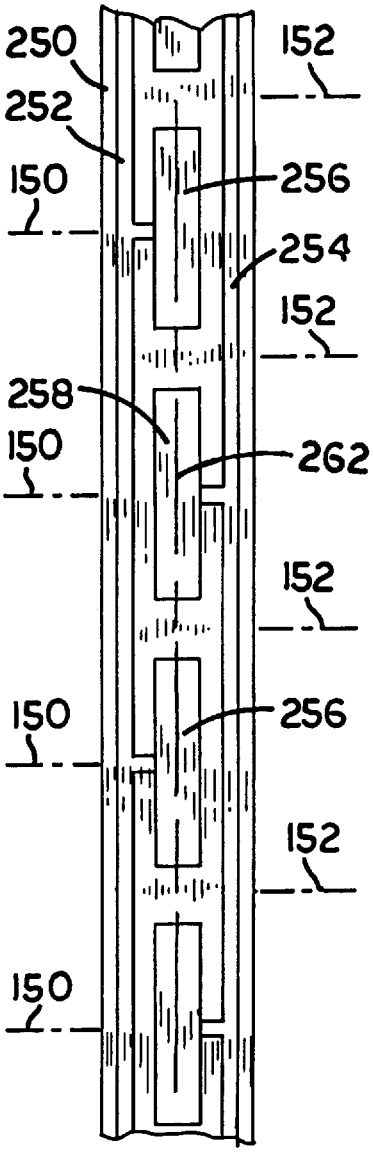
FIG. 7 is a schematic front view of a ribbon.

In FIG. 7, tape 250 bus 252 and 254 are coated with a dielectric. The only means for electrical conduction between the opposed surfaces of the folded tape are conductive surfaces 256 and 258. Surfaces 256 and 258 are configured on the tape so that when the tape is wrapped over the tops of the pocket walls and extends into the opening, fold-up lines 150 are on the tops of the walls, and a conductive surface is adjacent to the pocket inner wall surfaces adjacent to the tops of the walls. Fold-down lines 152 are at the lowermost part of the tape in the pocket. When conductive surface 256 is wrapped over the top edge of a wall of a pocket at fold-up line 150, and conductive surface 258 is at the top edge of the opposite wall of the pocket conductive surface 256 is wrapped over the top edge on a line 262 that is longitudinal with the ribbon through the conductive surface 258.

Figure 8:
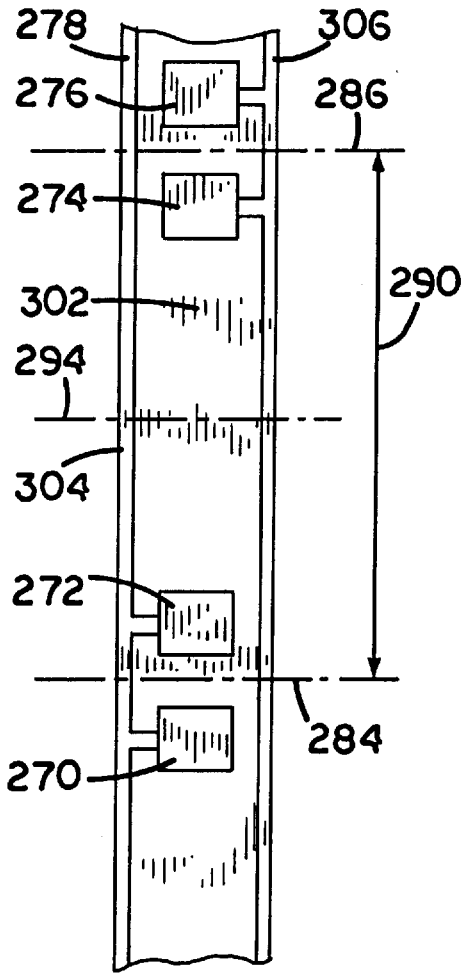
FIG. 8 is a schematic front view of a ribbon.

In FIG. 8, conductive surfaces 270, 272, 274, and 276 are configured suitable distances apart on tape 278 so that when the tape is folded over the tops of the pocket opening walls on fold-up lines 284, and 286, conductive surfaces 270, 272 are adjacent to the top of one wall of the opening, on each side of the wall, bowed away from the wall, and conductive surfaces 274 and 276 are adjacent to the top of, on each side of, and bowed out from the opposite wall of the opening.

The fold lines are indicated to the user by creases in the tape or the tape may be provided accordion folded for removably slipping it into wallet pockets.

Fold-up lines 284 and 286 are spaced apart on the tape a suitable distance 290 so that a document of predetermined size that is inserted into the tape when the tape is folded on fold-down line 294 extends between conductive surfaces 272 and 274. Fold-down line 294 is not equally spaced from fold-up lines 284 and 286, as the height above fold 294 of the wall upon which fold 286 rests is higher than the height above fold 294 of the wall upon which fold 284 rests.

The central longitudinal portion 302 of tape 278 is not covered with an electrically conductive surface. Bus 304 and 306 which are electrically connected to conductive surfaces 270, 272, and to 274, 276 respectively although being conductors to those surfaces are not electrically conductive surfaces because they are coated with a layer of insulation.

In FIGS. 5–8 the distance between the fold-up line and the fold-down line for a pocket is equal to or less than the height of the document to be inserted into the fold in the pocket.

Figure 9:
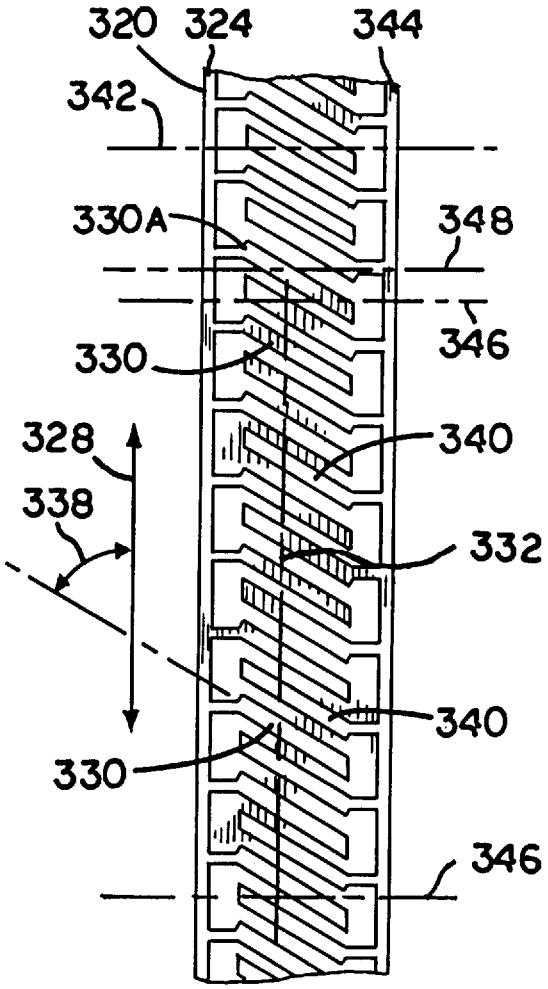
FIG. 9 is a schematic front view of a ribbon.

In FIG. 9, tape 320 is made from flexible resilient plastic. Electrical bus 324 extends along the ribbon lengthwise 328. Bus 324 is connected to electrically conductive surfaces configured in narrow strips 330 each of which extends over the ribbon in an angle that is transverse 338 to the length of the ribbon.

Electrical bus 344 extends along the ribbon lengthwise 328. Bus 344 is connected to electrically conductive surfaces configured in narrow strips 340 each of which extends over the ribbon in an angle that is transverse to the length of the ribbon.

Strips 330 and 340 are spaced from one another. They are preferably parallel to one another.

The length, spacing and angle of strips 330 and 340 is combined such that line 342 which is normal to the length of the ribbon passes through at least one strip 330 and at least one strip 340.

When the ribbon is folded over the top edge of a wall of a pocket opening and is folded within the pocket, regardless of the distance between the fold-up and fold-down at least one of conductive surface strips 320 and 340 is wrapped over the top edge of the wall.

When conductive surface strip 330*a* is folded over the top edge of a wall at fold-up line 346, a portion of the strip comprising line 348 extends into the pocket over the interior face of the wall adjacent to the top edge of the pocket wall, bowed away from the interior face of the wall adjacent to the top edge of the pocket.

When the ribbon is extended up over the opposite wall of the pocket, at least one each of strips 320 and 340 contact one another at the bow adjacent to a fold-up L 332 that is longitudinal with the ribbon passes through both conductive surface strips 330 and 340, and at least one of conductive surface strips 330 and 340 at fold-up line 346.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators

20 alarm system
22 electrical contact set
24 contact set
26 electrical contact set
28 electrical contact set
30 electrical contact set
32 credit card
34 credit card
36 credit card
38 credit card
40 contact
42 contact
44 contact
45 carbon conductive surface
46 contact
47 carbon conductive surface
48 contact
50 contact
52 contact
54 contact
56 contact
58 contact
60 bus
70 bus
72 wake-up pin
74 awaken
76 battery positive
78 battery negative
80 oscillator tune
82 reset
84 audio driver
86 audio driver
88 battery
90 speaker
92 battery positive
94 battery negative
96 external resistor
98 reset switch
100 resistor
102 capacitor
108 resistor
110 flexible resilient ribbon
114 top edge of wall 116
116 wall of pocket 118
118 pocket
120 wallet
124 interior face of wall 116
130 inward bow
132 inward, direction arrow
134 within
136 folded
138 top edge of wall 140
140 wall
142 bows
144 inward, direction arrow
146 inward, direction arrow
150 fold line
152 fold-down line
156 pocket
160 conductive surfaces
162 longitudinal bus
164 lengthwise portion
170 conductive surface
172 longitudinal bus
174 lengthwise portion
180 inward bow
182 inward bow
190 pocket
192 pocket
200 credit card
202 credit card
204 credit card
210 inward bow
212 inward bow
220 electronics case
222 inserting, direction arrow
224 end
228 end
230 flap
250 tape
252 bus
254 bus
256 conductive surface
258 conductive surface
270 conductive surface
272 conductive surface
274 conductive surface
276 conductive surface
278 tape
284 fold-up line
286 fold-up line
290 distance, arrow
294 fold-down line
302 central longitudinal portion
304 bus
306 bus
320 tape
324 electrical bus
328 lengthwise, arrow
330 strip
330*a* strip
338 transverse
340 strip
342 line normal to length of ribbon
344 electrical bus
346 fold-up line
348 line, falls adjacent to top edge of pocket wall

What is claimed is:

1. An alarm system for a document holder comprising:

a pocket comprising a closed bottom and a top having an opening for receiving a document, a first wall from the closed bottom to the top, a second wall from the closed bottom to the top, a top edge of the first wall forming a portion of the opening, a first inward interior face on said first wall, a second inward interior face on said second wall opposed to the first interior face, a flexible resilient ribbon having a length and comprising a first dielectric side and a second side, a first electrical bus extending along the ribbon lengthwise, a second electrical bus extending along the ribbon lengthwise, a first conductive surface on said first dielectric side of said ribbon, connected to said first bus and extending along a lengthwise portion of the first dielectric side of said ribbon, a second conductive surface on said first dielectric side of said ribbon, connected to said second bus and extending along a lengthwise portion of the first dielectric side of said ribbon and spaced lengthwise from said first conductive surface, an electrical circuit connected to said first bus and to said second bus comprising means for emitting an alarm when said first conductive surface electrically contacts said second conductive surface, and an electrical power source adapted to operate the electrical circuit, said flexible resilient ribbon being wrapped over said top edge of said first wall, so that it forms a third wall extending into said pocket over said first interior face of said first wall, and is bowed inward adjacent to said top edge away from said first interior face adjacent to said top edge by the resiliency, said ribbon being folded near the bottom of said pocket, forming a fourth wall extending over said second wall, said second conductive surface extending over said second interior face of said second wall opposite said first conductive surface so that said second conductive surface is in electrical contact with said first conductive surface at the inward bow, said inward bow urging said first conductive surface into contact with said second conductive surface adjacent to said top edge.

2. The alarm system of claim 1 wherein said first conductive surface on the ribbon is wrapped over said top edge of said first wall on a line longitudinal with said ribbon through said second conductive surface.

3. The alarm system of claim 1 wherein said first conductive surface is substantially carbon.

4. The alarm system of claim 1 further comprising:

said electrical circuit comprising means for delaying the alarm for a length of time after the contact is made.

5. The alarm system of claim 1 wherein said electrical circuit comprises an integrated circuit connected to said electrical power source and switched on to alarm by a high impedance low current threshold balance circuit comprising a fixed resistor and a pair of carbon conductive surfaces comprising said first conductive surface and said second conductive surface in series removable contact.

6. An alarm system designed for insertion into a document holder pocket, the pocket comprising a closed bottom and a top having an opening for receiving a document, a first wall from the closed bottom to the top, a second wall from the closed bottom to the top, a top edge of the first wall forming a portion of the opening, a first inward interior face on said first wall, a second inward interior face on said second wall opposed to the first interior face, the alarm system comprising:

a flexible resilient ribbon having a length and comprising a first dielectric side and a second side, a first electrical bus extending along the ribbon lengthwise, a second electrical bus extending along the ribbon lengthwise, a first conductive surface on said first dielectric side of said ribbon, connected to said first bus and extending along a lengthwise portion of the first dielectric side of said ribbon, a second conductive surface on said first dielectric side of said ribbon, connected to said second bus and extending along a lengthwise portion of the first dielectric side of said ribbon and spaced lengthwise from said first conductive surface, an electrical circuit connected to said first bus and to said second bus comprising means for emitting an alarm when said first conductive surface contacts said second conductive surface, and an electrical power source adapted to operate the electrical circuit, the locations on said ribbon of said first conductive surface, said second conductive surface being such that when said ribbon is folded over said top edge of said first wall forming a third wall extending into said pocket over said first interior face, and is folded within the pocket, said first conductive surface extends into said pocket over said first interior face of said first wall, on an inward bow of said ribbon bowed inward by the resiliency adjacent to said top edge away from said first interior face, and said second conductive surface extends over said second interior face of said second wall opposite said first conductive surface so that said second conductive surface is in electrical contact with said first conductive surface at said inward bow and said inward bow urges the first conductive surface into contact with the second conductive surface adjacent to the top edge.

7. The alarm system of claim 6 wherein the first and second conductive surfaces are so located on the ribbon so that when said first conductive surface on the ribbon is wrapped over said top edge of said first wall it is above said second conductive surface on a line longitudinal with said ribbon through said second conductive surface.

8. The alarm system of claim 6 further comprising:

means for delaying the alarm for a length of time after the contact is made, connected to said electrical circuit.

9. The alarm system of claim 6 wherein said electrical circuit comprises an integrated circuit connected to said electrical power source and switched on to alarm by a high impedance low current threshold balance circuit comprising a fixed resistor and a pair of carbon conductive surfaces comprising said first conductive surface and said second conductive surface in series removable contact.

10. An alarm system designed for insertion into a document holder pocket, the pocket comprising a closed bottom and a top having an opening for receiving a document, a first wall from the closed bottom to the top, a second wall from the closed bottom to the top, a top edge of the first wall forming a portion of the opening, a first inward interior face on said first wall, a second inward interior face on said second wall opposed to the first interior face, the alarm system comprising:

a flexible ribbon having a length and comprising a first dielectric side and a second side, a first electrical bus extending along the ribbon lengthwise, a second electrical bus extending along the ribbon lengthwise, a first conductive surface on said first dielectric side of said ribbon, connected to said first bus and extending along a lengthwise portion of the first dielectric side of said ribbon over said ribbon in an angle that is transverse to the length of the ribbon and transverse to a normal to the length, a second conductive surface on said first dielectric side of said ribbon, connected to said second bus and extending along a lengthwise portion of the first dielectric side of said ribbon, and spaced from said first conductive surface, the first and second conductive surfaces extending over said ribbon so that a line logitudinal with said ribbon passes through the first and second conductive surfaces on said first dielectric side, an electrical circuit connected to said first bus and to said second bus comprising means for emitting an alarm when said first conductive surface contacts said second conductive surface, and an electrical power source adapted to operate the electrical circuit.

11. The alarm system of claim 10 wherein said second conductive surface extends in an angle that is transverse to the length of the ribbon and transverse to a normal to the length.

12. The alarm system of claim 11 wherein said first conductive surface and said second conductive surface are configured so that a line drawn across the ribbon normal to the length of the ribbon passes through said first conductive surface and said second conductive surface.

13. The alarm system of claim 11 wherein locations of said first conductive surface and said second conductive surface on said ribbon are such that when said ribbon is folded over said top edge of said first wall, and is folded within the pocket, one of said first conductive surface and said second conductive surface is wrapped over said top edge of said first wall.

14. The alarm system of claim 11 wherein said ribbon is resilient locations of said first conductive surface and said second conductive surface are such that when said ribbon is folded over said top edge of said first wall, and is folded within the pocket, one of said first conductive surface and said second conductive surface is wrapped over said top edge of said first wall forming a third wall and extends into said pocket over said first interior face bowed by the resiliency of said ribbon inward away from said first interior face adjacent to said top edge, and said ribbon is folded near the bottom of said pocket, and the other of said first conductive surface and said second conductive surface extends over said second interior face opposite said first conductive surface so that the first and second conductive surfaces are in electrical contact at said inward bowed location adjacent the top edge.

* * * * *

UNITED STATES PATENT AND TRADEMARK OFFICE

CERTIFICATE OF CORRECTION

PATENT NO. : 5,892,444

DATED : April 6, 1999

INVENTOR(S) : Kenneth E. Wittmer; Cliff Evans

It is certified that error appears in the above-identified patent and that said Letters Patent is hereby corrected as shown below: On the title page, item [56]:

Insert under "References Cited, U.S.PATENT DOCUMENTS" on the front page:

| | | |
|---|---|---|
| --4,480,250 | 10/1984 | McNeely |
| 4,652,865 | 3/1987 | Maharshak |
| 4,692,745 | 9/1987 | Simanowitz |
| 4,717,908 | 1/1988 | Phillips et al. |
| 4,719,453 | 1/1988 | Beck et al. |
| 4,794,378 | 12/1988 | Chen et al. |
| 4,857,897 | 8/1989 | Chen |
| 4,916,434 | 4/1990 | McNeely |
| 4,987,403 | 1/1991 | Apfel |
| 5,053,749 | 10/1991 | Weiss |
| 5,396,218 | 3/1995 | Olah |
| 5,418,520 | 5/1995 | Hirshberg |
| 5,642,095 | 6/1997 | Cook-- |

Signed and Sealed this

Tenth Day of August, 1999

*Attest:*

Q. TODD DICKINSON

*Attesting Officer*

*Acting Commissioner of Patents and Trademarks*